US012392536B2

(12) United States Patent
Jeong et al.

(10) Patent No.: US 12,392,536 B2
(45) Date of Patent: Aug. 19, 2025

(54) REFRIGERATOR AND CONTROLLING METHOD THEREOF

(71) Applicant: Samsung Electronics Co., Ltd., Suwon-si (KR)

(72) Inventors: Jin Jeong, Suwon-si (KR); Bongsu Son, Suwon-si (KR); Kwanyeol Lee, Suwon-si (KR); Dongho Lee, Suwon-si (KR); Hocheol Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 232 days.

(21) Appl. No.: 18/322,094

(22) Filed: May 23, 2023

(65) Prior Publication Data

US 2023/0296303 A1 Sep. 21, 2023

Related U.S. Application Data

(63) Continuation of application No. PCT/KR2021/095099, filed on Nov. 10, 2021.

(30) Foreign Application Priority Data

Jan. 8, 2021 (KR) ..... 10-2021-0002764

(51) Int. Cl.
*F25C 1/25* (2018.01)
*F25C 1/04* (2018.01)

(52) U.S. Cl.
CPC . *F25C 1/25* (2018.01); *F25C 1/04* (2013.01)

(58) Field of Classification Search
CPC ..... F25C 1/25; F25C 1/10; F25C 2500/06; F25C 2400/14; F25C 2700/06; F25C 1/20; F25C 1/04
See application file for complete search history.

(56) References Cited

U.S. PATENT DOCUMENTS 9,599,388 B2 3/2017 Boarman et al.
9,841,217 B2 12/2017 Lee et al.
(Continued)

FOREIGN PATENT DOCUMENTS

EP 2743613 B1 5/2019
JP H06-011228 A 1/1994
(Continued)

OTHER PUBLICATIONS

English language translation of JP200678097 to Shigenaka. Translated Mar. 2025 (Year: 2006).*
(Continued)

*Primary Examiner* — Cassey D Bauer
(74) *Attorney, Agent, or Firm* — Jefferson IP Law, LLP

(57) ABSTRACT

The disclosure relates to a refrigerator including an ice making tray in which a plurality of ice making cells forms and including at least one partition wall dividing the plurality of ice making cells into a plurality of regions, a water supply device provided to supply water to any one of the plurality of regions, a rotation motor providing a driving force to rotate the ice making tray in a first direction or in a second direction opposite to the first direction, and a controller configured to control the water supply device to supply a predetermined amount of water to one of the plurality of regions, and to control the rotation motor to rotate the ice making tray in the first direction when the supply of water to the one region is completed and rotate the ice making tray in the second direction when a predetermined time elapses.

10 Claims, 16 Drawing Sheets

(56) References Cited

U.S. PATENT DOCUMENTS

| | | | |
|---|---|---|---|
| 11,079,153 | B2 | 8/2021 | Song et al. |
| 2006/0242986 | A1 | 11/2006 | Sugaya et al. |
| 2022/0003477 | A1 | 1/2022 | Lee et al. |

FOREIGN PATENT DOCUMENTS

| | | | |
|---|---|---|---|
| JP | H06-59772 | A | 3/1994 |
| JP | H06-59772 | U | 8/1994 |
| JP | 2002-318044 | A | 10/2002 |
| JP | 2003-232587 | A | 8/2003 |
| JP | 2005-127698 | A | 5/2005 |
| JP | 2006-078097 | A | 3/2006 |
| KR | 10-0347040 | B1 | 8/2002 |
| KR | 10-2006-0053132 | A | 5/2006 |
| KR | 10-0801349 | B1 | 2/2008 |
| KR | 10-1519152 | B1 | 5/2015 |
| KR | 10-2015-0099913 | A | 9/2015 |
| KR | 10-2018-0093666 | A | 8/2018 |
| KR | 10-2020-0038107 | A | 4/2020 |

OTHER PUBLICATIONS

International Search Report dated Mar. 4, 2022, issued in International Patent Application No. PCT/KR2021/095099.
European Search Report Apr. 24, 2024, issued in European Application No. 21917965.2.

* cited by examiner

REFRIGERATOR AND CONTROLLING METHOD THEREOF

CROSS-REFERENCE TO RELATED APPLICATION(S)

This application is a continuation application, claiming priority under § 365(c), of an International application No. PCT/KR2021/095099, filed on Nov. 10, 2021, which is based on and claims the benefit of a Korean patent application number 10-2021-0002764, filed on Jan. 8, 2021, in the Korean Intellectual Property Office, the disclosure of which is incorporated by reference herein in its entirety.

BACKGROUND

1. Field

The disclosure relates to a refrigerator. More particularly, the disclosure relates to a refrigerator including an ice maker and a control method thereof.

2. Description of Related Art

In general, a refrigerator is an apparatus that keeps food fresh by including a storage compartment and a cold air supply device for supplying cold air to the storage compartment. An ice maker for making ice may be provided in the refrigerator.

The ice maker generates ice in the order of water supply, ice making, and ice separation, and these processes are performed in an ice making tray.

In order to uniformly distribute supplied water in the ice making tray in the water supply process, the ice maker has water channels formed between adjacent ice making cells to disperse the supplied water.

However, the above-described water channel structure has a disadvantage in that ice is generated even in a space where the water channel is formed, so that an ice fragment or ice powder different from the shape of the ice making cell is generated in the ice separation process.

In order to compensate for the above disadvantage, an ice making tray having no water channel structure may be used, but such an ice making tray may not uniformly disperse the supplied water.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a refrigerator including an ice maker capable of uniformly supplying water to all ice making cells even in an ice making tray having no water channel structure.

Another aspect of the disclosure is to provide a refrigerator including an ice making tray in which a plurality of ice making cells forms and including at least one partition wall dividing the plurality of ice making cells into a plurality of regions, a water supply device provided to supply water to any one of the plurality of regions, a rotation motor providing a driving force to rotate the ice making tray in a first direction or in a second direction opposite to the first direction, and a controller configured to control the water supply device to supply a predetermined amount of water to one of the plurality of regions, and to control the rotation motor to rotate the ice making tray in the first direction when the supply of water to the one region is completed and rotate the ice making tray in the second direction when a predetermined time elapses.

The ice making tray may include a first region in which water is stored by supplying water from the water supply device and a second region in which a part of the water stored in the first region is stored by rotation of the ice making tray in the first direction.

When the supply of water to the first region is completed, the controller may control the rotation motor to tilt the ice making tray at a predetermined angle in the first direction, and move a part of the water stored in the first region to the second region.

When the predetermined time elapses, the controller may control the ice making tray to rotate in the second direction and keep the ice making tray in a horizontal state.

The ice making tray may include a first region in which water is stored by supplying water from the water supply device, a third region to which a part of the water stored in the first region is moved, and a second region in which a part of the water stored in the first region and the third region is stored by rotation of the ice making tray in the first direction.

When the supply of water to the first region is completed, the controller may fix the ice making tray for a first predetermined time and move a part of the water stored in the first region to the third region.

When the first predetermined time elapses, the controller may control the rotation motor to tilt the ice making tray at a predetermined angle in the first direction.

The controller may fix the ice making tray for a second predetermined time in a state in which the ice making tray is tilted, and move a part of the water stored in the first region and the third region to the second region.

When the second predetermined time elapses, the controller may control the ice making tray to rotate in the second direction and keep the ice making tray in a horizontal state.

The controller may control a blowing fan to guide cold air to an ice maker so as to cool the water stored in the ice making tray.

Another aspect of the disclosure is to provide a control method of a refrigerator provided with an ice maker including an ice making tray, a water supply device, and a rotation motor providing a driving force to rotate the ice making tray in a first direction or in a second direction opposite to the first direction, wherein the control method includes controlling the water supply device to supply a predetermined amount of water to one of a plurality of regions of the ice making tray, controlling the rotation motor to rotate the ice making tray in the first direction when the supply of water to the one region is completed, and controlling the rotation motor to rotate the ice making tray in the second direction when a predetermined time elapses.

The ice making tray may include a first region in which water is stored by supplying water from the water supply device and a second region in which a part of the water stored in the first region is stored by rotation of the ice making tray in the first direction.

The controlling of the rotation motor to rotate the ice making tray in the first direction may include controlling the rotation motor to tilt the ice making tray at a predetermined angle in the first direction when the supply of water to the first region is completed, and moving a part of the water stored in the first region to the second region.

The controlling of the rotation motor to rotate the ice making tray in the first direction may include controlling the ice making tray to rotate in the second direction when the predetermined time elapses, and keeping the ice making tray in a horizontal state.

The ice making tray includes a first region in which water is stored by supplying water from the water supply device, a third region to which a part of the water stored in the first region is moved, and a second region in which a part of the water stored in the first region and the third region is stored by rotation of the ice making tray in the first direction.

The control method further includes fixing the ice making tray for a first predetermined time when the supply of water to the first region is completed, and moving a part of the water stored in the first region to the third region.

The controlling of the rotation motor to rotate the ice making tray in the first direction may include controlling the rotation motor to tilt the ice making tray at a predetermined angle in the first direction when the first predetermined time elapses.

The controlling of the rotation motor to rotate the ice making tray in the first direction may include fixing the ice making tray for a second predetermined time in a state in which the ice making tray is tilted, and moving a part of the water stored in the first region and the third region to the second region.

The controlling of the rotation motor to rotate the ice making tray in the second direction may include controlling the ice making tray to rotate in the second direction when the second predetermined time elapses, and keeping the ice making tray in a horizontal state.

The control method may further include controlling a blowing fan to guide cold air to an ice maker so as to cool the water stored in the ice making tray.

Additional aspects will be set forth in part in the description which follows and, in part, will be apparent from the description, or may be learned by practice of the presented embodiments.

According to an aspect of the disclosure, the quality of ice-making may be improved by supplying a uniform amount of water to all ice making cells in an ice making tray having no water channel structure.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

The same reference numerals are used to represent the same elements throughout the drawings.

DETAILED DESCRIPTION

Figure 1:
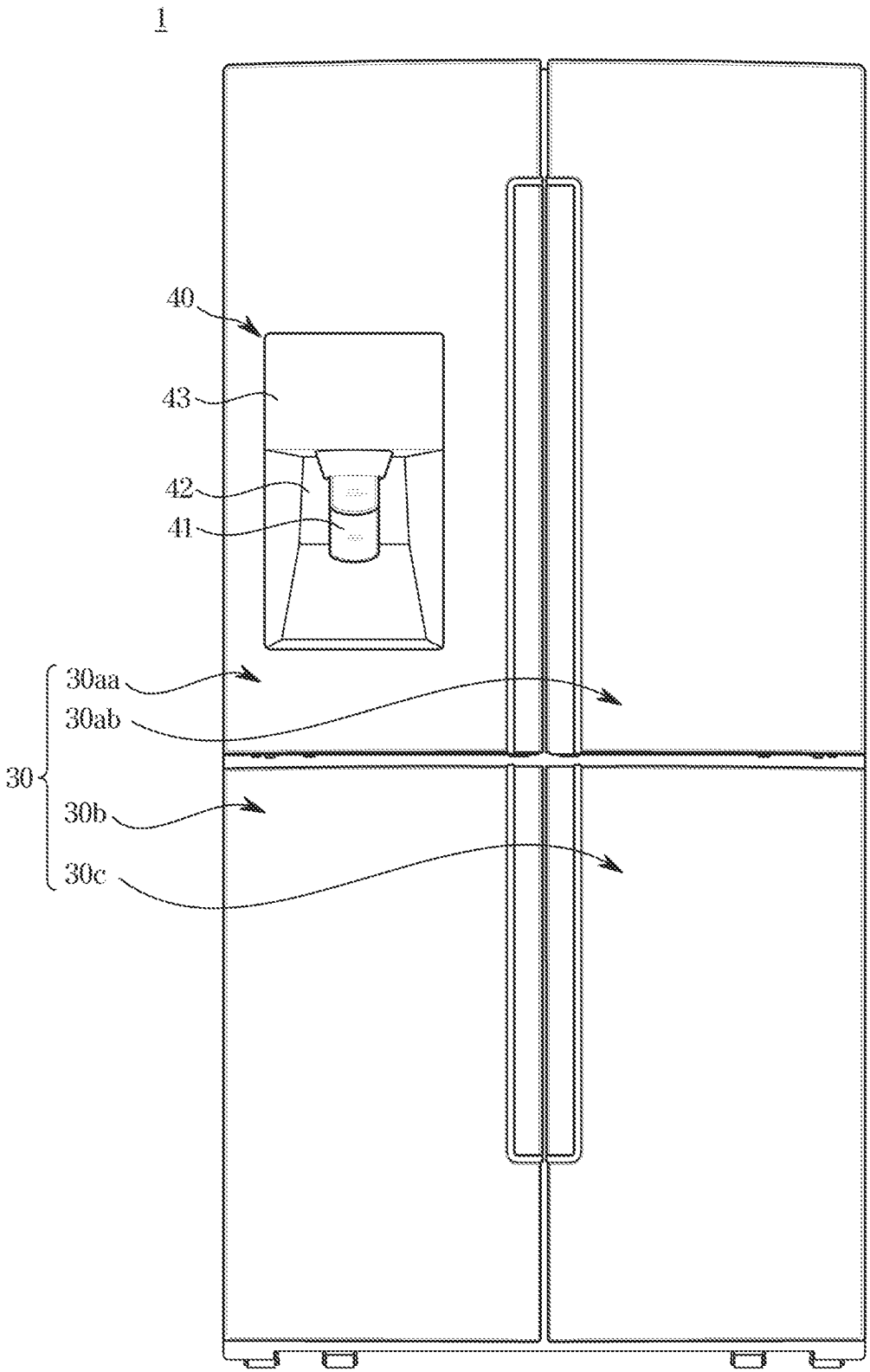
FIG. 1 illustrates an exterior of a refrigerator according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The terms 'member,' 'unit,' 'module,' and 'device' used in this specification may be embodied as software or hardware, and it is also possible for a plurality of 'members,' 'units,' and 'devices' to be embodied as one component, or for one 'member,' 'unit,' 'module,' and 'device' to include a plurality of components, according to the embodiments.

Throughout the specification, when a part is referred to as being "connected" to another part, it includes not only a direct connection but also an indirect connection, and the indirect connection includes connecting through a wireless network.

When it is described that a part "includes" a component, it means that the component may further include other components, not excluding the other components unless specifically stated otherwise.

Throughout the specification, when a component is referred to as being located "on" or "over" another component, this includes not only a case in which a component is in contact with another component but also a case in which another component exists between the two components.

The terms 'first,' 'second,' etc. are used to distinguish a component from another component, and the components are not limited by the above-mentioned terms.

In each operation, an identification numeral is used for convenience of explanation, the identification numeral does not describe the order of the operations, and each operation may be performed differently from the order specified unless the context clearly states a particular order.

Hereinafter, embodiments of the disclosure will be described in detail with reference to the accompanying drawings.

FIG. 1 illustrates an exterior of a refrigerator according to an embodiment of the disclosure.

Figure 2:
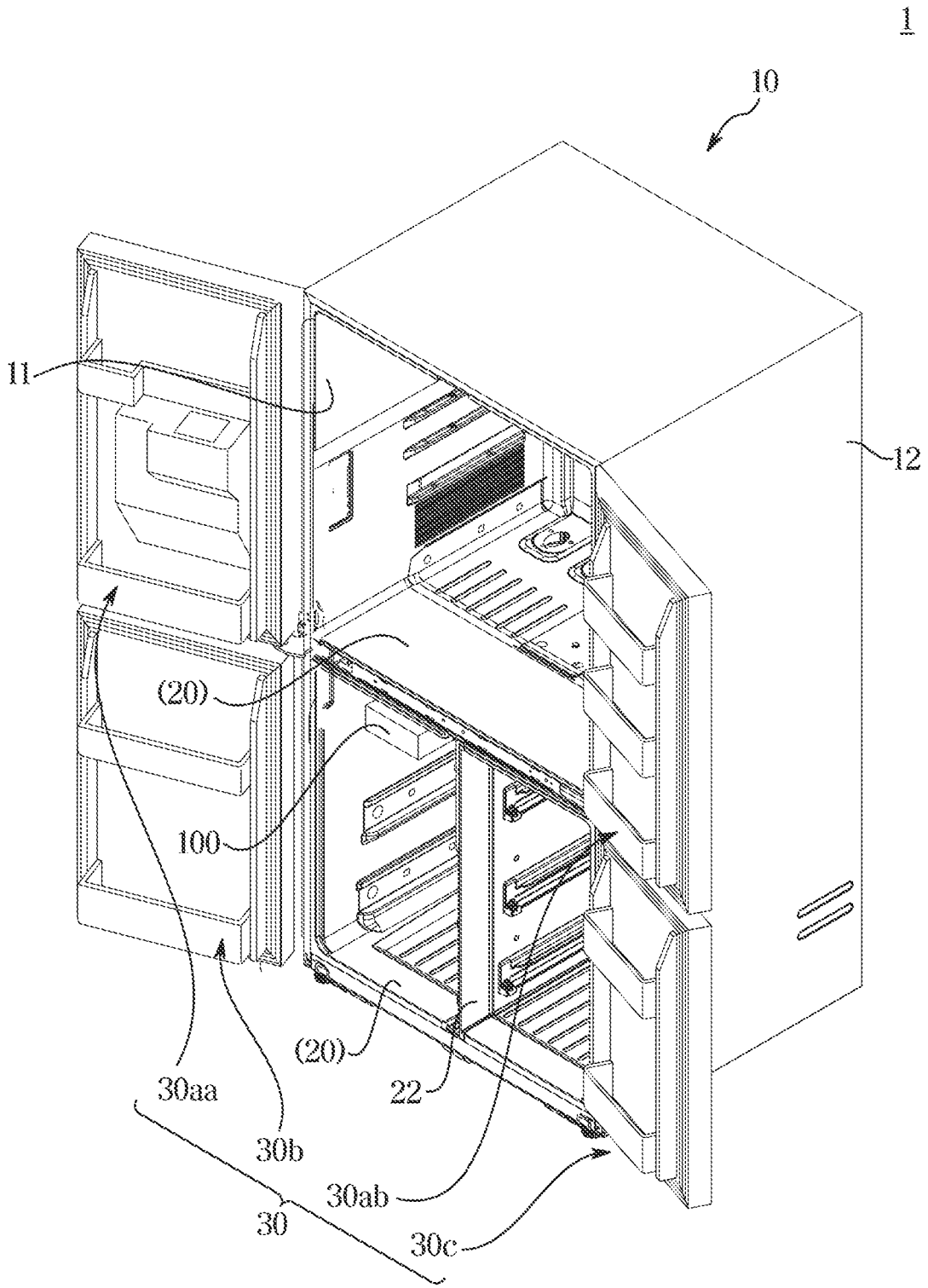
FIG. 2 illustrates a front view of the refrigerator according to an embodiment of the disclosure.

FIG. 2 illustrates a front view of the refrigerator according to an embodiment of the disclosure.

Figure 3:
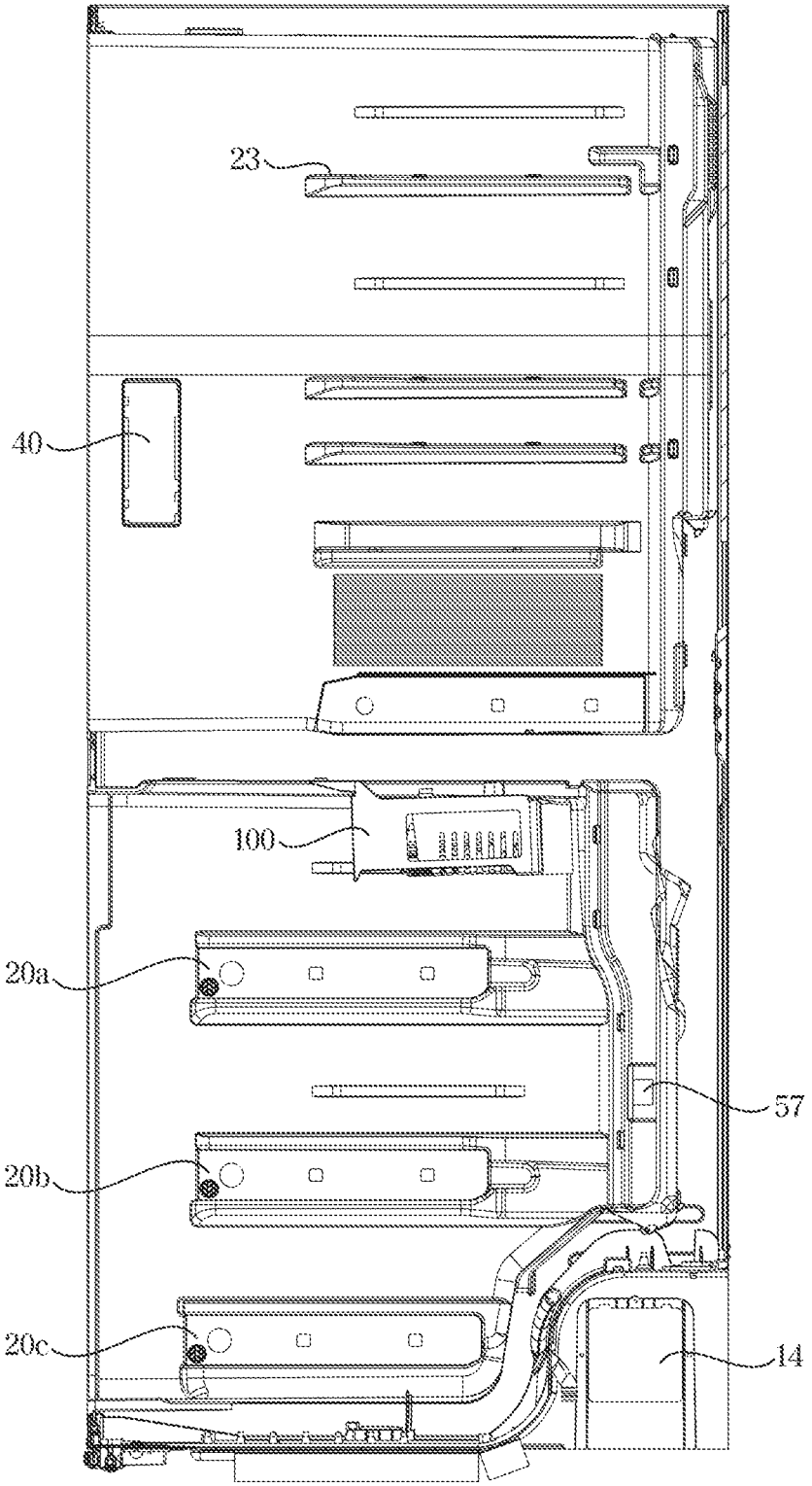
FIG. 3 illustrates a vertical cross-sectional view of the refrigerator according to an embodiment of the disclosure.

FIG. 3 illustrates a vertical cross-sectional view of the refrigerator according to an embodiment of the disclosure.

Referring to FIGS. 1, 2, and 3, a refrigerator 1 includes a main body 10 having an open front side, a storage compartment 20 formed inside the main body 10 so that food is stored in a refrigerated and/or frozen state, a door 30 provided to open and close the open front side of the main body 10, a cooling system (not shown) for cooling the storage compartment 20, and an ice maker 100 configured to make ice.

The main body 10 forms an exterior of the refrigerator 1. The main body 10 includes an inner case 11 forming a storage compartment 20 and an outer case 12 coupled to the outside of the inner case 11. A heat insulating material 13 capable of preventing cold air in the storage compartment 20 from leaking out is filled between the inner case 11 and the outer case 12 of the main body 10.

A plurality of the storage compartments 20 may be provided by being partitioned by a horizontal partition wall 21 and a vertical partition wall 22. For example, as illustrated in FIG. 2, the storage compartment 20 is partitioned into an upper storage compartment 20*a*, a first lower storage compartment 20*b*, and a second lower storage compartment 20*c*. The upper storage compartment 20*a* may store food in the refrigerated state, and the lower storage compartments 20*b* and 20*c* may store food in the frozen state.

A shelf 23 on which food may be placed is provided in the storage compartment 20.

The storage compartment 20 may be opened and closed by the door 30. For example, as illustrated in FIG. 2, the upper storage compartment 20*a* is opened and closed by a first upper door 30*aa* and a second upper door 30*ab*. The first lower storage compartment 20*b* may be opened and closed by a first lower door 30*b*, and the second lower storage compartment 20*c* may be opened and closed by a second lower door 30*c*.

A handle 31 may be provided on the door 30 so that the door 30 may be easily opened and closed. The handle 31 may be formed to extend vertically between the first upper door 30*aa* and the second upper door 30*ab* and between the first lower door 30*b* and the second lower door 30*c*. Accordingly, when the door 30 is closed, the handle 31 may be viewed as being integrally formed.

A dispenser 40 may be provided on one side of the door 30. The dispenser 40 may dispense water or ice depending on a user input. In other words, a user may directly take out water or ice through the dispenser 40 without opening the door 30.

The dispenser 40 includes a dispenser lever 41 to which a dispensing command of the user is input, a dispenser chute 42 through which ice is discharged from the ice maker 100, and a dispenser display panel 43 displaying an operation of the dispenser 40.

The dispenser 40 may be installed outside the door 30 or the main body 10. For example, as illustrated in FIG. 1, the dispenser 40 is installed on the first upper door 30*aa*. However, the dispenser 40 is not limited to being installed on the first upper door 30*a*, and may be installed anywhere, such as the second upper door 30*ab*, the first lower door 30*b*, the second lower door 30*c*, and the outer case 12 of the main body 10, as long as the user may take out water or ice therein.

At the rear of the storage compartment 20, a heat exchanger (not shown) and a blowing fan 35 are installed to generate cold air and supply the cold air separately to the refrigerating compartment and the freezing compartment, respectively. At a rear lower side of the main body 10, a machine room 14 is provided in which a compressor (not shown) and a condenser (not shown) are installed to compress a refrigerant, condense the compressed refrigerant, and transfer the compressed refrigerant to the heat exchanger 34.

Each of the doors 30 is installed on a front side of each of the storage compartments 20 so that the inside thereof may be selectively opened and closed. A plurality of guards is installed in multiple stages on a rear surface of each of the doors 30 so that food may be easily stored, and storage compartments 20*a*, 20*b*, and 20*c* such as a plurality of shelves and drawers are installed inside the storage compartment 20.

The refrigerator 1 includes the ice maker 100 installed in the storage compartment to make ice, and an ice container 121 provided to store the ice generated in the ice maker 100. In this case, because the ice container 121 and the dispenser 40 are the same as those commonly used, a detailed description thereof will be omitted.

Although FIG. 3 illustrates a structure of an indirect cooling type in which cold air generated in the freezing compartment is guided to the ice maker 100 to cool water on an ice making tray 111 as a method of cooling the ice maker 100, there is a direct cooling type in which a separate refrigerant pipe is disposed in the ice making tray 111 to provide cold air directly to cool water on the ice making tray 111, and the embodiments according to the disclosure may be applied to both the indirect cooling type and the direct cooling type.

Figure 4:
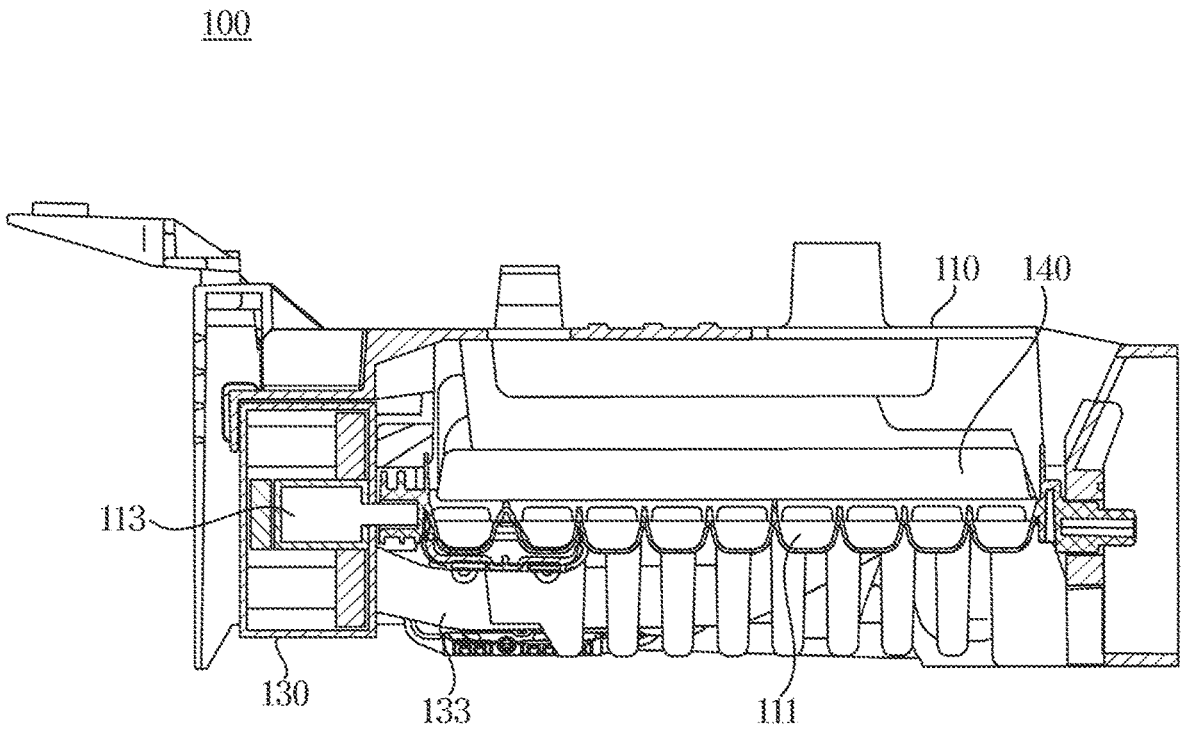
FIG. 4 illustrates a structure of an ice maker included in the refrigerator according to an embodiment of the disclosure.

FIG. 4 illustrates a structure of an ice maker included in the refrigerator according to an embodiment of the disclosure.

Referring to FIG. 4, the ice maker 100 may include the ice making tray 111, a drive unit 130 to rotate the ice making tray 111, and a cooling case 140 to generate ice in the ice making tray 111.

A plurality of ice making cells 111*a* is formed in the ice making tray 111 to receive water supplied from the outside through a water supply device 320 to generate ice. The ice making tray 111 may be made of a plastic material capable of being twisted in order to separate ice from the plurality of ice making cells 111*a*.

The drive unit 130 includes a rotation motor 113 to rotate the ice making tray 111. As shown, the drive unit 130 serves to rotate the ice making tray 111 inside a support frame 110 according to the rotation of the rotation motor 113 by being axially connected to the ice making tray 111. An ice-full detection lever 133 provided to detect whether ice stored in an ice container (not shown) is full may be installed in the drive unit 130.

The ice maker 100 may include a support member (not shown) mounted on one side of the cooling case 140 and a plurality of blades (not shown) extending from the support member to correspond to the respective ice making cells 111*a*. The plurality of blades serves to separate ice from the respective ice making cells 111*a* by blocking the ice generated in the respective ice making cells 111*a* when the ice making tray 111 rotates.

One or more of the plurality of blades extend from the support member to have different lengths in order to twist the ice making tray 111 when the ice making tray 111 rotates. Specifically, the plurality of blades is provided to have a longer length as the blades are further away from the drive unit 130. That is, in the embodiment of the disclosure, when the ice making tray 111 rotates, ice generated in the respective ice making cells 111*a* is sequentially blocked with the blades in a direction away from the drive unit 130, so that the ice making tray 111 twists, and thus the ice generated in the ice making cells 111*a* is separated.

Figure 5:
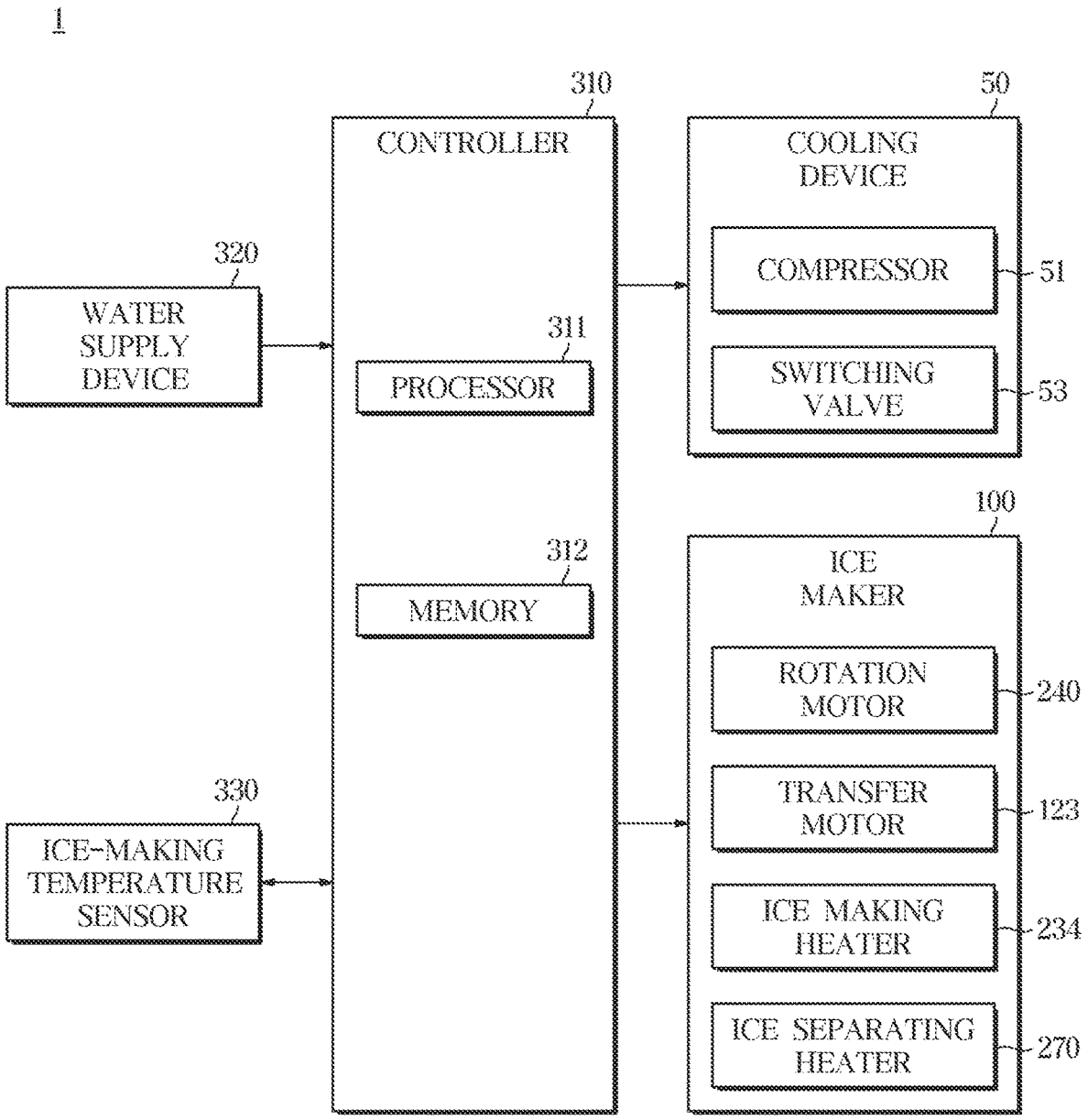
FIG. 5 illustrates a control block diagram of the refrigerator according to an embodiment of the disclosure.

FIG. 5 illustrates a control block diagram of the refrigerator according to an embodiment of the disclosure.

Referring to FIG. 5, the refrigerator 1 includes, together with the components described above, the water supply device 320 provided to supply water to the ice making tray 111, an ice-making temperature sensor 330 provided to measure a temperature of the ice maker 100, a cooling device 50 provided to cool the storage compartment 20, and a controller 310 configured to control the ice maker 100 making ice.

The water supply device 320 is provided above the ice making tray 111 and may supply water to any one area of the ice making tray 111 depending on a control signal from the controller 310. Depending on a control signal from the controller 310, an amount of water to be supplied by the water supply device 320 or a time to supply water may be adjusted.

The water supply device 320 is movable in a horizontal direction based on the ice making tray 111, so that a position of the water supply device 320 with respect to the ice making cell to which water is supplied may be changed.

As described with reference to FIG. 3, the cooling device 50 may include a compressor 51, a condenser, expansion devices, evaporator 57 (see FIG. 3), a refrigerant pipe, and a switching valve 53.

The compressor 51 may compress the refrigerant to a high pressure in response to a control signal from the controller 310 and discharge the high-pressure refrigerant to the condenser. The switching valve 53 may supply the refrigerant to at least one of an evaporator in the upper storage compartment 20*a* (see FIG. 3) and the evaporator 57 (see FIG. 3) in the lower storage compartment 20*b* (see FIG. 3) in response to a control signal from the controller 310. In other words, in response to a control signal from the controller 310, the compressor 51 may generate a flow of the refrigerant, and the switching valve 53 may control a flow path of the refrigerant.

The ice maker 100 may include ice making trays 210 and 220, a stirrer 230, a rotation motor 240, an ice container 121 (see FIG. 3), a transfer device 122 (see FIG. 3), a transfer motor 123 (see FIG. 3), an ice making heater 234, and an ice separating heater 270.

In response to a control signal from the controller 310, the rotation motor 240 may drive the stirrer 230 that agitates or stirs water. The rotation motor 240 may rotate the ice making tray 111 at a predetermined angle in response to a control signal from the controller 310, and may keep the ice making tray 111 in a stopped state for a predetermined time in a tilted state after rotating the ice making tray 111 at the predetermined angle. In response to a control signal from the controller 310, the transfer motor 123 may drive the transfer device 122 to discharge ice from the ice maker 120.

The ice making heater 234 for keeping a temperature inside the ice maker 100 below freezing and the ice separating heater 270 for heating the ice maker 100 to separate ice from the ice maker 100 may be provided.

The controller 310 may include a memory 312 for storing programs and data for controlling operations of the refrigerator 1, and a processor 311 for generating control signals for controlling the operations of the refrigerator 1 according to programs and data stored in the memory 312. The processor 311 and the memory 312 may be implemented as separate chips or as a single chip.

The memory 312 may store control programs and control data for controlling the operations of the refrigerator 1, and various application programs and application data for performing various functions according to user input. Also, the memory 312 may temporarily store outputs of a storage compartment temperature sensor and the ice-making temperature sensor 330.

The memory 312 may include a volatile memory for temporarily storing data, such as a static random access memory (S-RAM) and a dynamic random access memory (D-RAM). Also, the memory 312 may include a non-volatile memory for long-term storage of data, such as a read only memory (ROM), an erasable programmable read only memory (EPROM), and an electrically erasable programmable read only memory (EEPROM).

The processor 311 may include various logic circuits and arithmetic circuits, process data according to a program provided from the memory 312, and generate a control signal depending on a processing result.

For example, the controller 310 controls the water supply device 320 so that the water supply device 320 supplies water to the ice making tray 111, and depending on a control signal of the controller 310, the amount of water to be supplied or the time to supply water may be adjusted. Also, the controller 310 may control the rotation motor 113 so that the ice making tray 111 rotates at the predetermined angle, and may control the rotation motor 113 to stop the ice making tray 111 in a state of being rotated at the predetermined angle. Also, the controller 310 may control the rotation motor 113 so that the ice making tray 111 returns to a horizontal state from the rotated state. The controller 310 may control the ice maker 100 to cool the water stored in the ice making tray 111. Specifically, an ice-making refrigerant pipe may extend into the ice maker 100, and the ice-making refrigerant pipe disposed inside the ice maker 100 cools the water in the ice maker 100 to make ice.

Hereinafter, the ice making tray 111 referred to in the disclosure will be described in more detail with reference to FIGS. 6 and 7.

Figure 6:
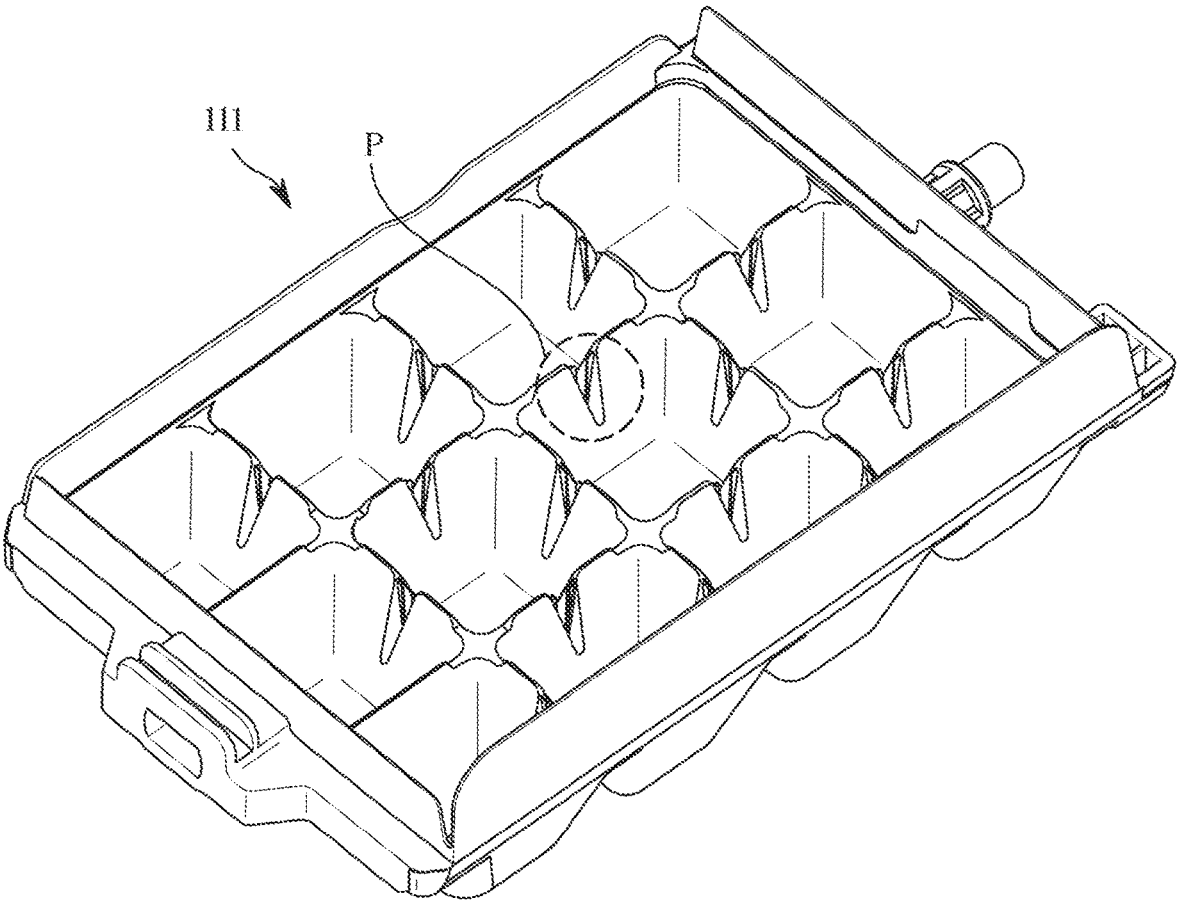
FIG. 6 illustrates a conventional ice making tray employing a water channel structure according to an embodiment of the disclosure.

FIG. 6 illustrates a conventional ice making tray employing a water channel structure according to an embodiment of the disclosure.

Figure 7:
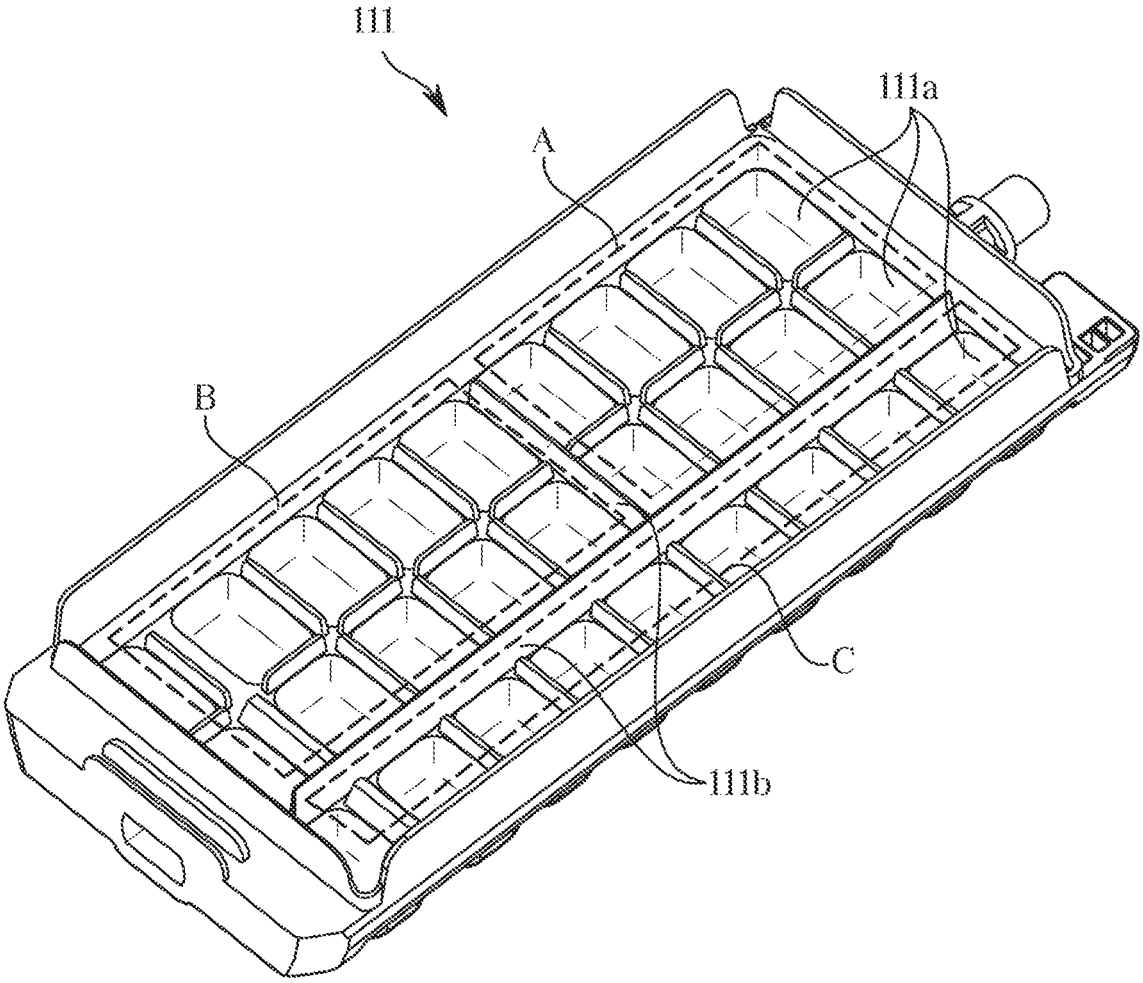
FIG. 7 illustrates a structure of an ice making tray according to an embodiment of the disclosure.

FIG. 7 illustrates a structure of an ice making tray according to an embodiment of the disclosure.

Referring to FIG. 6, a conventional ice making tray 111 includes a plurality of ice making cells, and water channels P are formed between the adjacent ice making cells. Water supplied for ice making is supplied to one ice making cell of the plurality of ice making cells, and the water is stored throughout the ice making tray 111 through the water channels P formed between the ice making cells. However, because ice is formed in the water channels P in addition to being formed in the ice-making cells, it is difficult for the ice to have a perfect hexahedral shape, and ice pieces or ice powder different from the shape of the ice making cell may be generated.

On the other hand, as illustrated in FIG. 7, the ice making tray 111 may form the plurality of ice making cells 111*a* without employing a water channel structure. However, when water is supplied to any one ice making cell of the plurality of ice making cells in the ice making tray 111 in which no water channel is formed, water may not be uniformly stored. Therefore, the ice maker 100 (FIG. 4) according to another embodiment of the disclosure may uniformly store water by performing the water supply control and rotation control of the ice making tray 111. Specific control processes for this will be described later.

Referring to FIG. 7, the ice making tray 111 according to yet another embodiment may include the plurality of ice making cells 111*a* in which no water channel is formed, and at least one partition wall 111*b* for separating the plurality of ice making cells 111*a* into a plurality of regions A, B, and C. The partition wall 111*b* corresponds to a means for preferentially storing water in one region when the water is supplied to the ice making tray 111. When the ice making tray 111 is in the horizontal state, water may be supplied to only one region or sequentially supplied to different regions by the partition wall 111*b*.

The partition wall 111*b* is formed to be higher than a first rib 111*c* formed between the adjacent ice making cells 111*a*, so that before transferred between the plurality of regions A, B, and C, water is uniformly distributed to the respective ice making cells 111*a* in one region. For example, due to the height difference between the partition wall 111*b* and the first rib 111*c*, water storage is performed in the order of the region A and the region B.

As illustrated in FIG. 7, the two partition walls 111*b* may be provided such that the ice making tray 111 has a structure of three divided regions. Also, unlike that illustrated in FIG. 7, the one partition wall 111*b* may be formed parallel to a rotational axis of the ice making tray 111 so that the ice making tray 111 has two divided regions.

The partition wall 111*b* may be integrally formed with the ice making tray 111 by injection molding of the ice making tray 111. Also, the partition wall 111*b* may be provided in a separate form so as to be detachable from the ice making tray 111, and may set a region in which water is preferentially supplied by changing a position of the partition wall 111*b* by the user.

Figure 8:
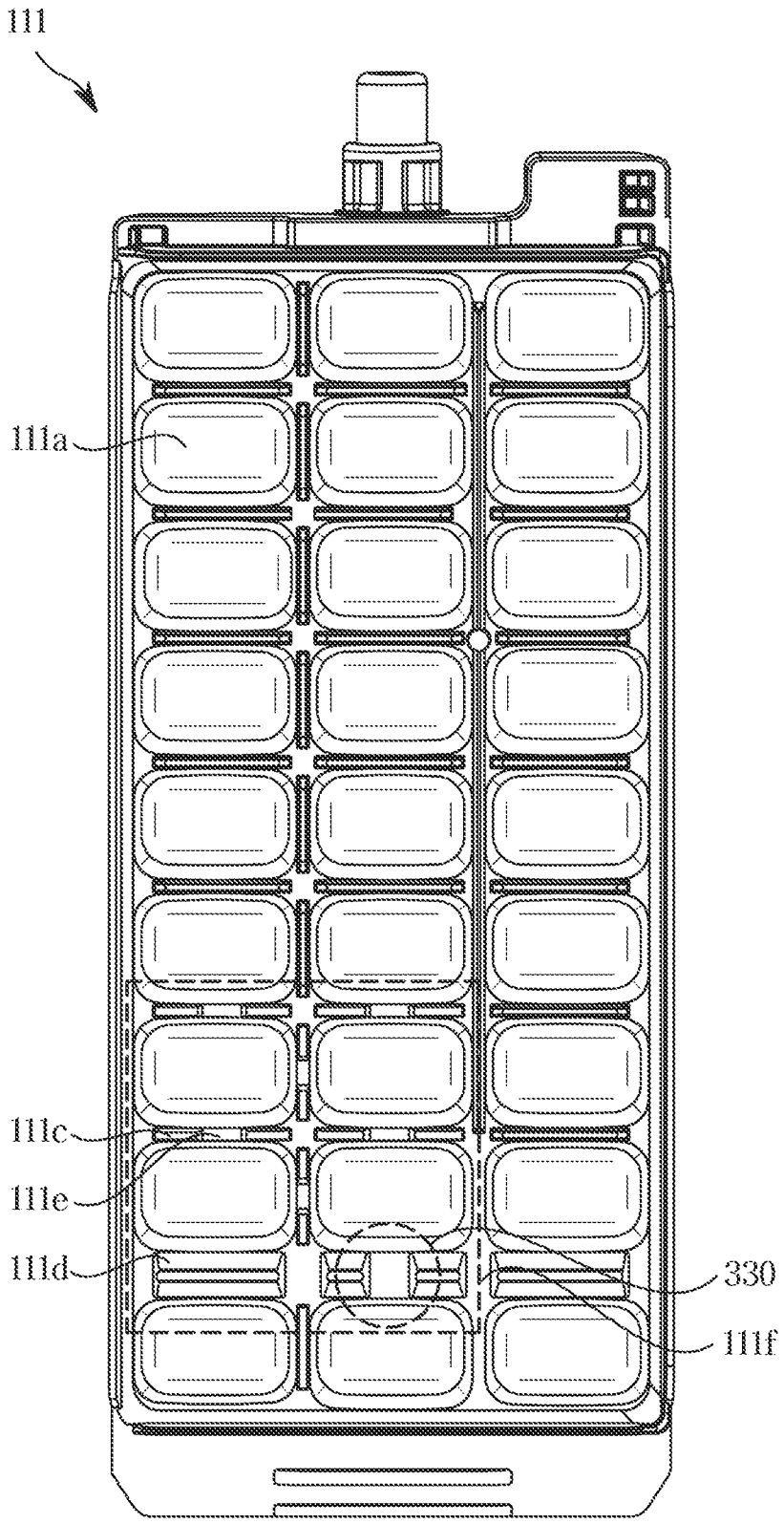
FIGS. 8, 9, and 10 illustrate a structure of an ice making tray according to various embodiments of the disclosure.
Figure 9:
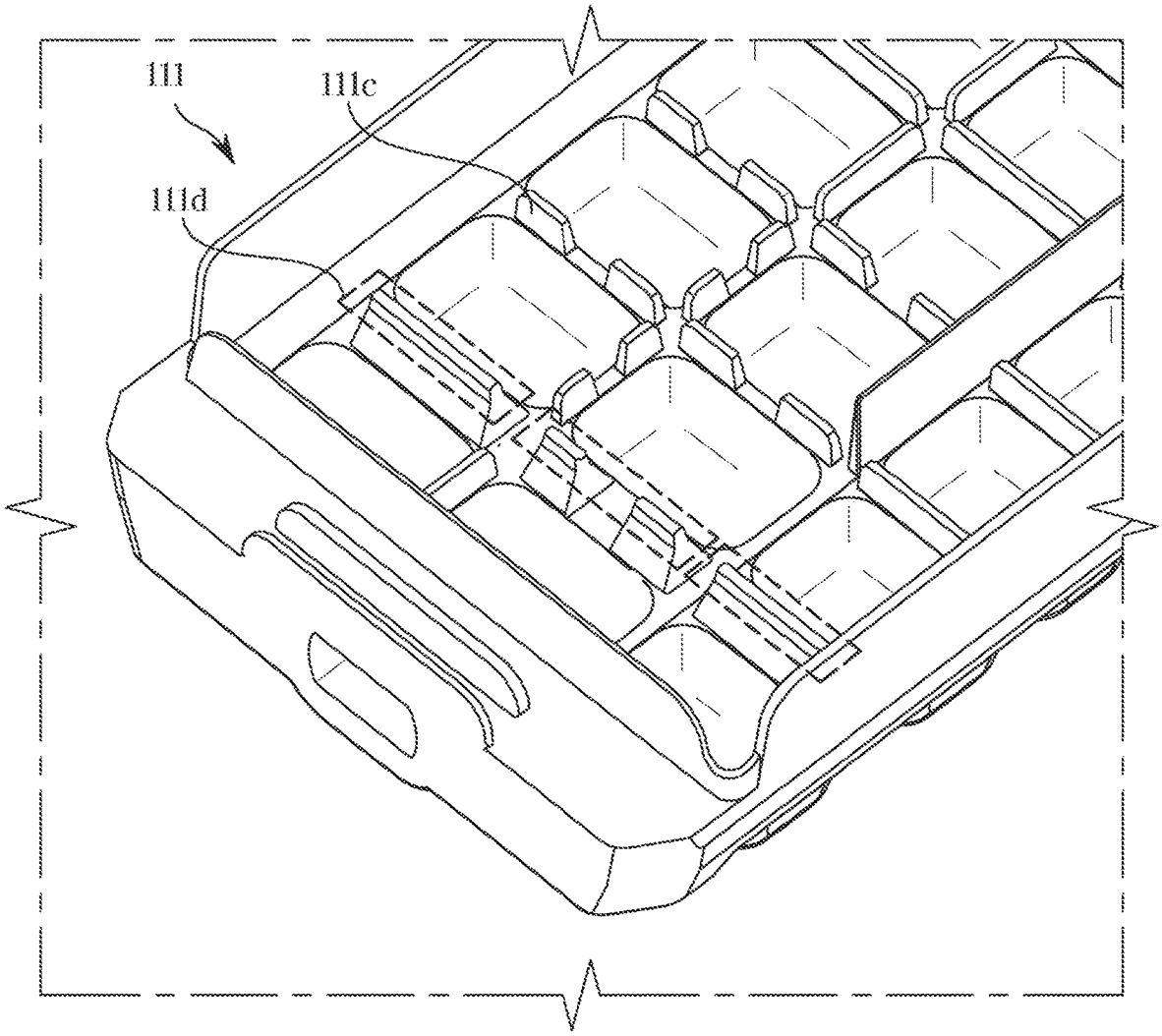
Figure 10:
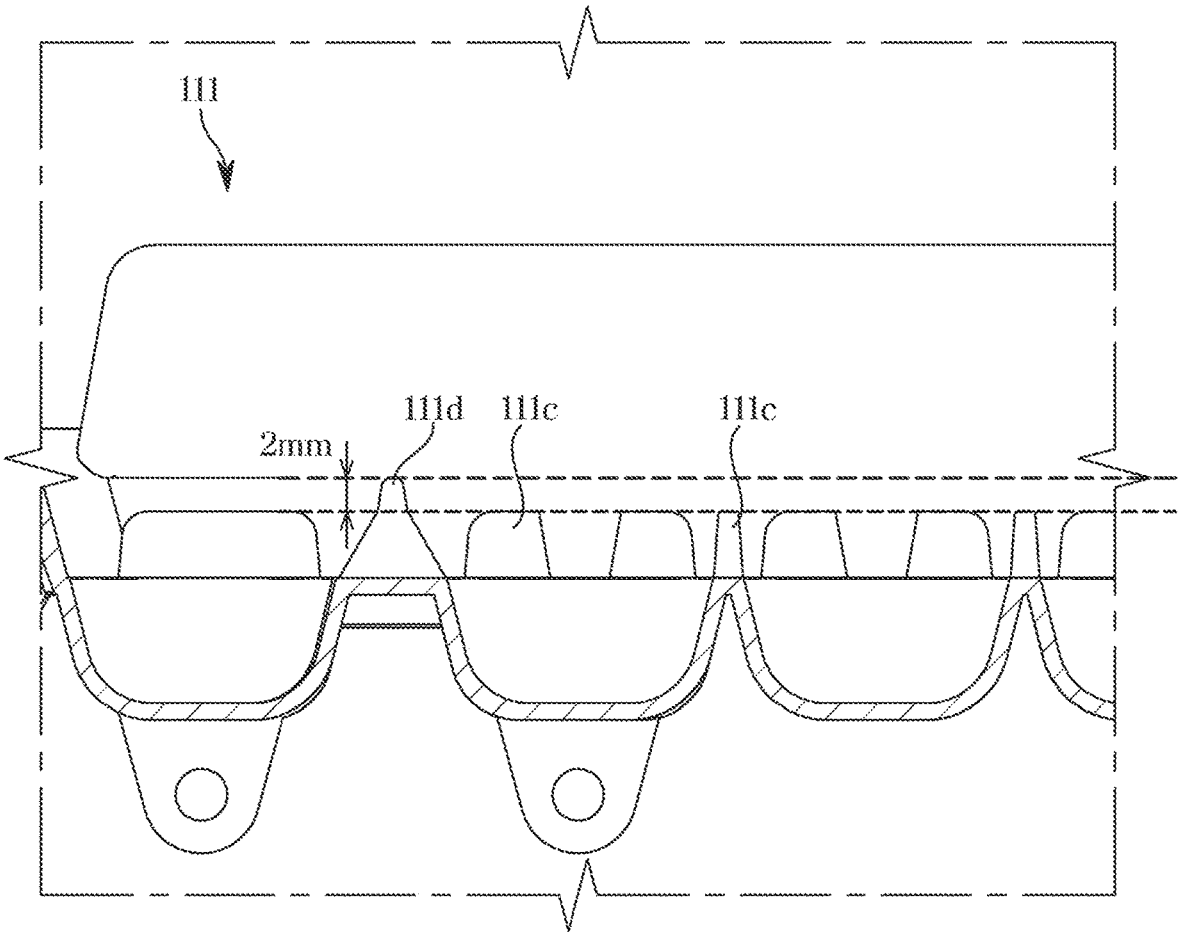

FIGS. 8 to 10 illustrate a structure of an ice making tray according to various embodiments of the disclosure.

Referring to FIG. 8, the ice making tray 111 according to the embodiment may be provided with a plurality of ribs 111*c* and 111*d* to form a first rib hole 111*e*, which is a groove of a certain size, between the adjacent ice making cells 111*a* so as to allow water to move smoothly between the plurality of ice making cells 111*a*. Unlike the conventional ice making tray in which the water channel is formed to the bottom of the ice making cell 111*a*, with the above structure, a constant height between the ice making cells 111*a* is kept and the plurality of ribs 111*c* and 111*d* is additionally formed, so that water may move uniformly between the adjacent ice making cells 111*a*. In this case, the plurality of ribs 111*c* and 111*d* may be disposed between the adjacent ice making cells 111*a* with two to form the first rib hole 111*e*.

A plurality of the first rib holes 111*e* is formed between the adjacent ice making cells 111*a* to adjust an amount of movement of water in row and column directions.

Referring to FIGS. 9 and 10, the second rib 111*d* formed at an end of the plurality of ribs 111*c* and 111*d* may be formed to be higher than the first rib 111*c*. This reflects the characteristic that the end of the ice making tray 111 is inclined downward, and is to prevent more than necessary water from being distributed to the last row of the ice making cells (lower row based on FIG. 8).

Referring back to FIG. 8, the ice-making temperature sensor 330 may be provided below the ice making tray 111 based on a row position corresponding to a second rib hole 111*f*. The first rib hole 111*e* and the second rib hole 111*f* facilitate the movement of stored water to the end of the ice making tray 111 so that a measure temperature of the ice-making temperature sensor 330 may be easily performed.

The components and the operation of each component of the refrigerator 1 according to an embodiment have been described above. Hereinafter, processes for uniformly supplying water to the ice making tray 111 based on the above-described components will be described in detail in order.

Figure 11:
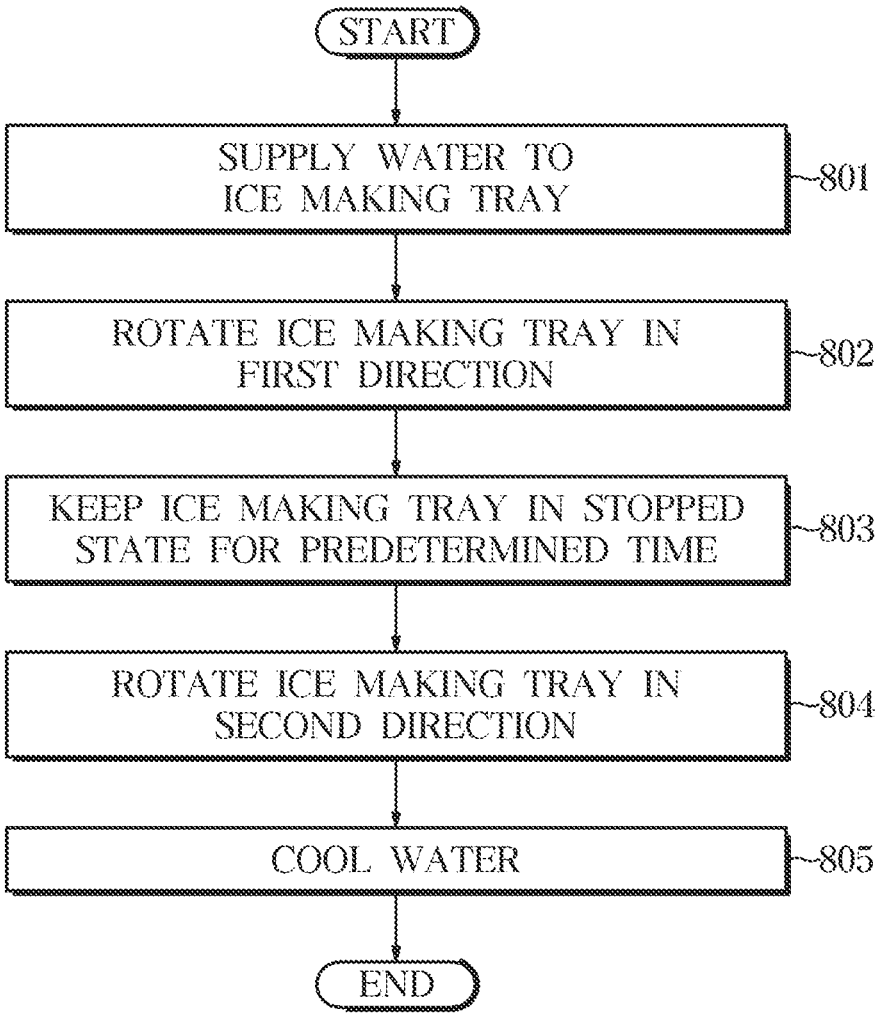
FIG. 11 illustrates a flowchart of a control method of the refrigerator according to an embodiment of the disclosure.

FIG. 11 illustrates a flowchart of a control method of the refrigerator according to an embodiment of the disclosure.

Figure 12:
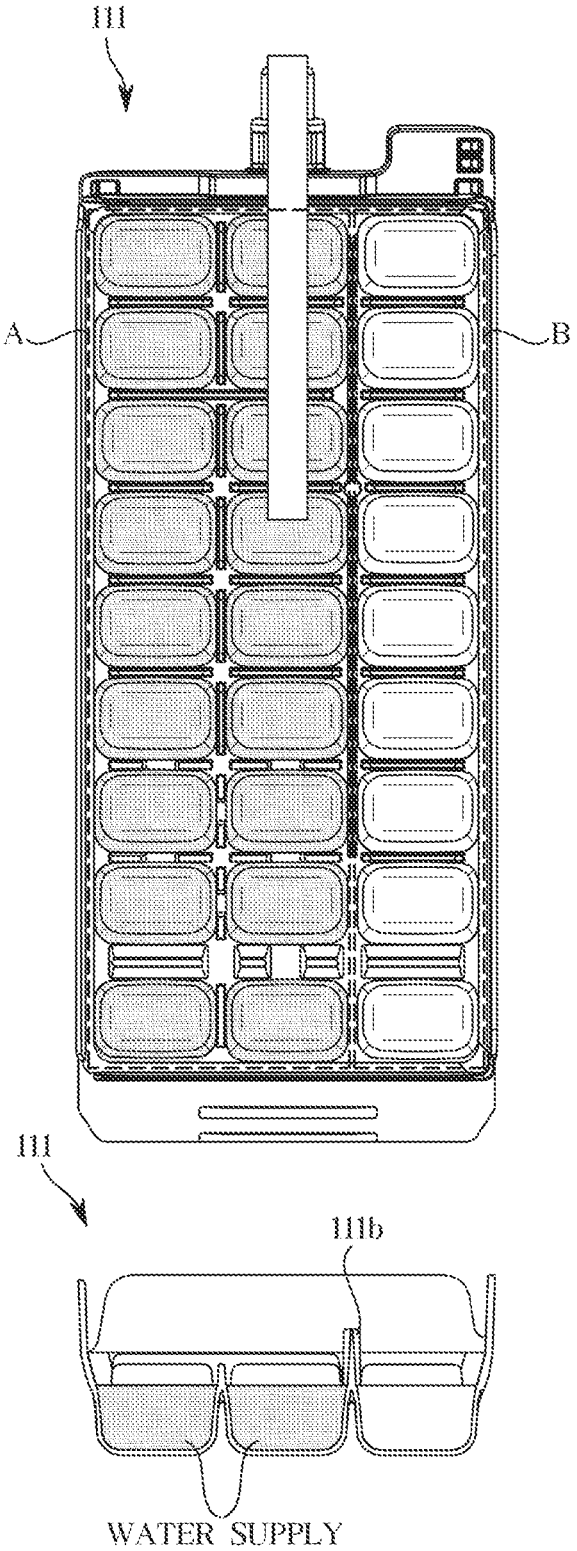
FIGS. 12, 13, and 14 illustrate views for explaining the flowchart of FIG. 11 in more detail according to various embodiments of the disclosure.
Figure 13:
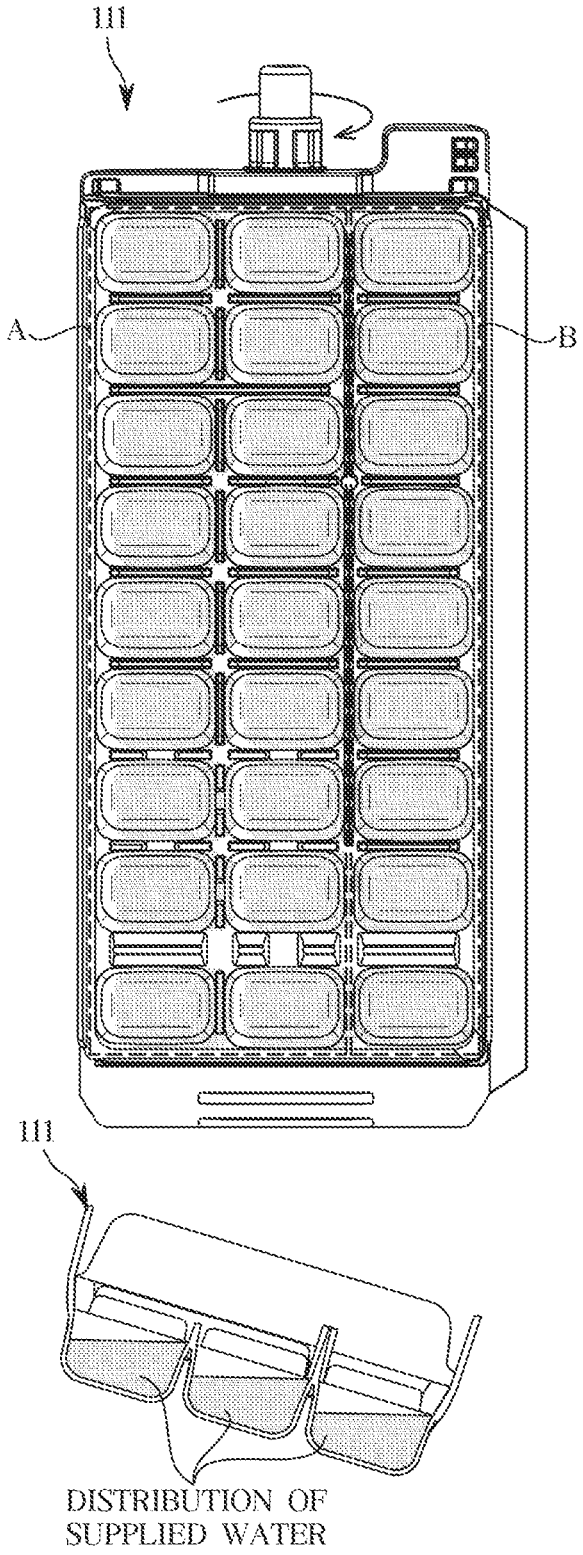
Figure 14:
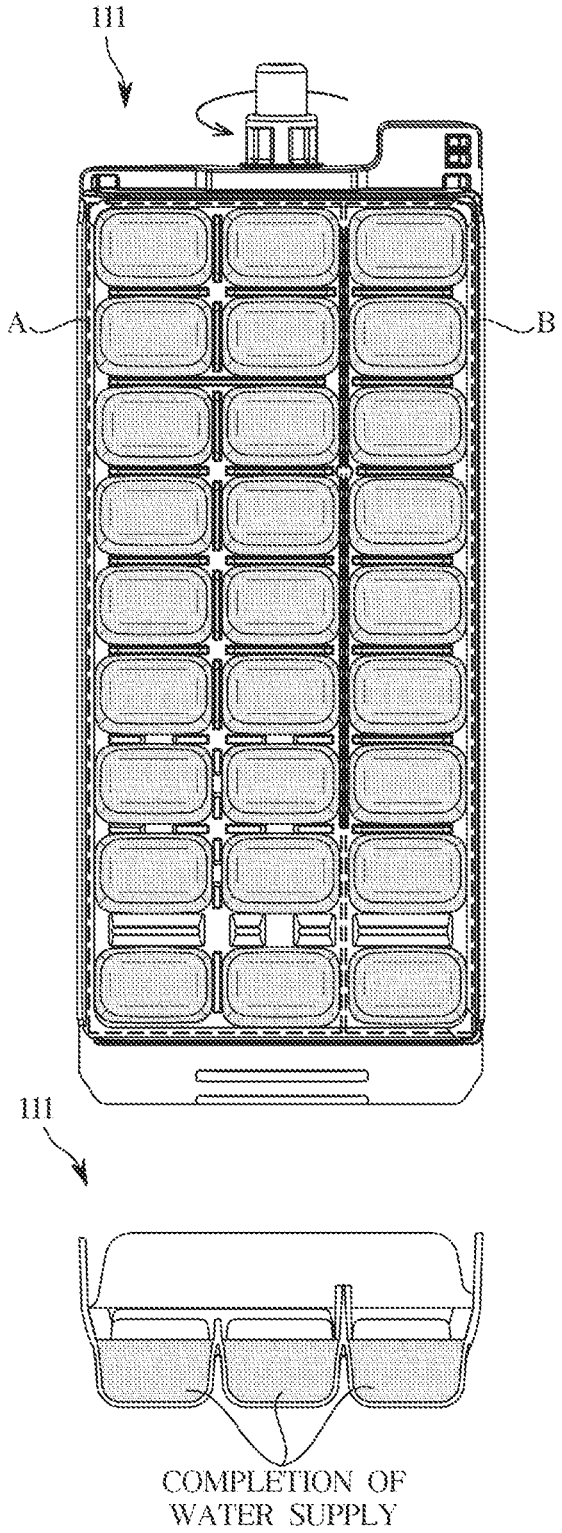

FIGS. 12, 13, and 14 illustrate views for explaining the flowchart of FIG. 11 in more detail according to various embodiments of the disclosure.

The controller 310 controls the water supply device 320 to supply water to the ice making tray 111 operation 801. In this case, the controller 310 may control the water supply device 320 to preferentially supply water to one of the divided regions of the ice making tray 111.

For example, referring to FIG. 12, the water supply device 320 preferentially supplies water to the first region A according to a control signal from the controller 310. At this time, the ice making tray 111 is in the horizontal state, and water may be stored only in the first region A by the partition wall between the first region A and the second region B. The controller 310 controls the water supply device 320 to adjust the amount of water to be supplied or the time to supply water. The controller 310 according to another embodiment may control the water supply device 320 to supply a predetermined amount of water to the ice making tray 111. Herein, the predetermined amount of water may correspond to an amount at which all of the ice making cells belonging to the first region A reach a full water level. The water stored in the first region A may be moved to the second region B according to a process which will be described later.

When the supply of water to the ice making tray 111 is completed, the controller 310 controls the ice making tray 111 to rotate in a first direction operation 802. Specifically, the controller 310 controls the rotation motor 113 connected to the ice making tray 111 to tilt the ice making tray 111 at the predetermined angle.

Referring to FIG. 13, the first direction is a direction in which water stored in the first region A is moved to the second region B, and indicates a direction in which an altitude of a region where water is stored is higher than that of a region where no water is stored.

After the ice making tray 111 rotates at the predetermined angle, the controller 310 keeps the ice making tray 111 in the stopped state for the predetermined time in the tilted state operation 803. The predetermined time is a sufficient time for a part of the water stored in the first region A to be moved to the second region B, and may be about 5 to 10 seconds.

Therefore, water stored in one region of the ice making tray 111 may be uniformly stored in all of the ice making cells according to an altitude difference between the first region A and the second region B.

The controller 310 rotates the ice making tray 111 in a second direction operation 804. Specifically, the controller 310 may control the rotation motor 113 connected to the ice making tray 111 to return the ice making tray 111 to the horizontal state that is an original state. Herein, the second direction is opposite to the first direction described above, and corresponds to a direction of returning the tilted ice making tray 111 to the horizontal state.

For example, referring to FIG. 14, when water is uniformly stored in all of the ice making cells formed in the ice making tray 111, the controller 310 controls the rotation motor 113 to return the ice making tray 111 to the horizontal state.

When the ice making tray 111 returns to the horizontal state, the controller 310 controls the ice maker 100 to cool the water stored in the ice making tray 111 operation 805. Therefore, according to the disclosure, water is uniformly supplied to all of the ice making cells even without forming a water channel in the ice making tray 111, so that the quality of ice making may be improved by preventing adjacent ice cubes from sticking together.

Figure 15:
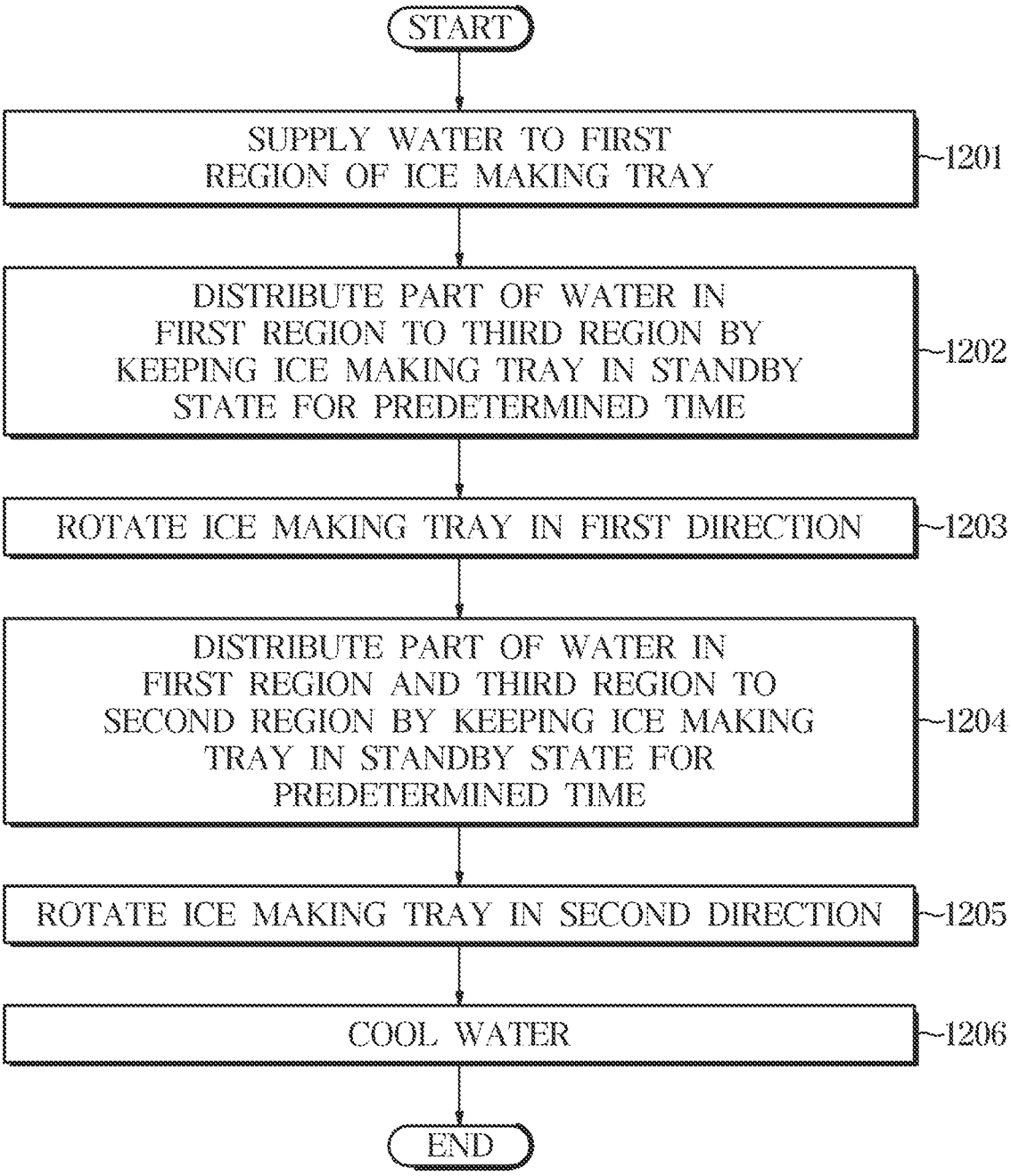
FIG. 15 illustrates a flowchart of a control method of the refrigerator according to an embodiment of the disclosure.
Figure 16:
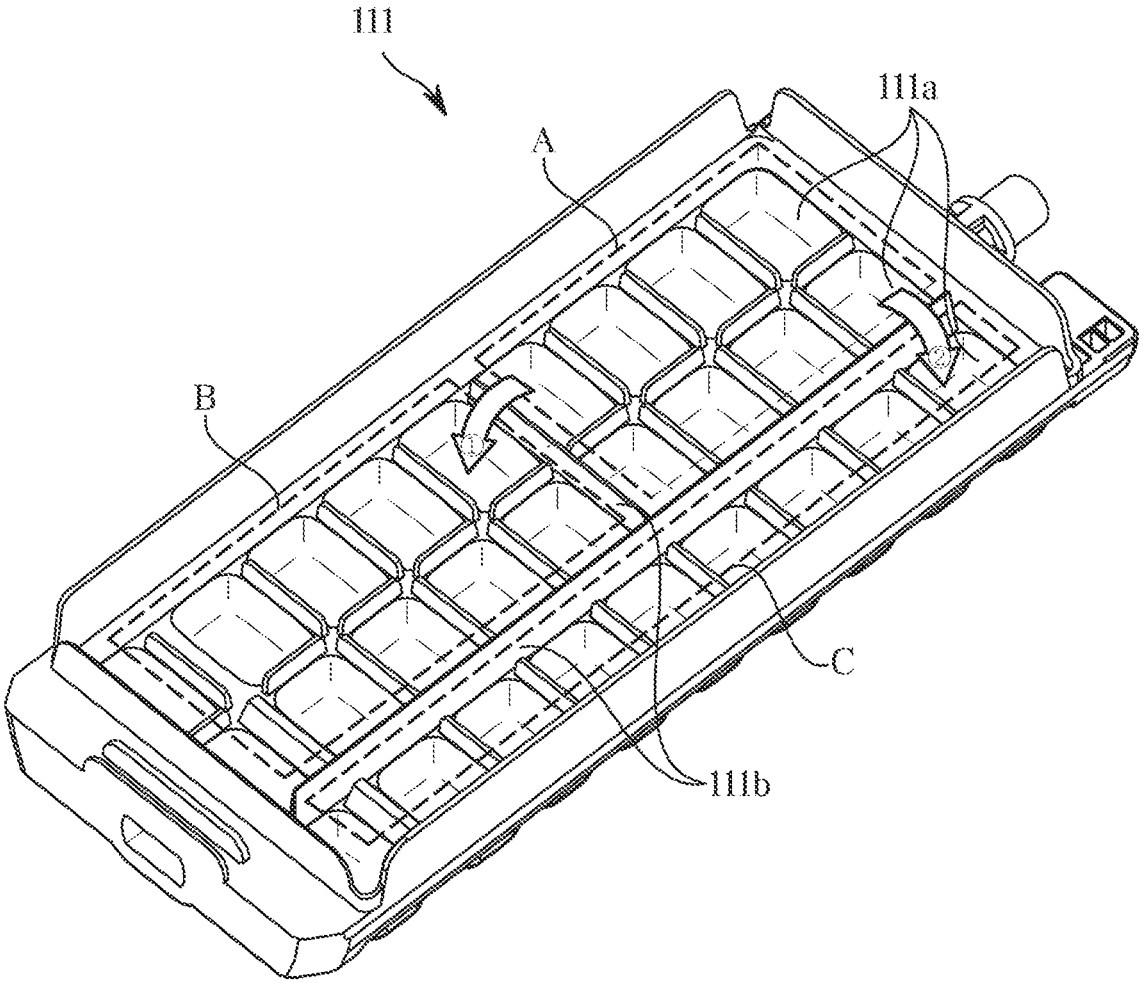
FIG. 16 illustrates a view for explaining the flowchart of FIG. 15 in more detail according to an embodiment of the disclosure.

FIG. 15 illustrates a flowchart of a control method of the refrigerator according to an embodiment of the disclosure, and FIG. 16 illustrates a view for explaining the flowchart of FIG. 15 in more detail according to an embodiment of the disclosure.

The controller 310 controls the water supply device 320 to supply water to the ice making tray 111 operation 1201. In this case, the controller 310 may control the water supply device 320 to preferentially supply water to one of the divided regions of the ice making tray 111.

Referring FIG. 13, the ice making tray 111 according to this embodiment has two partition walls formed therein, so that the ice making cells 111*a* of the ice making tray 111 may be divided into a first region A, a second region C, and a third region B. The controller 310 preferentially supplies water to the first region A, and controls the water stored in the first region A to be distributed to the third region B and the second region C in order.

The controller 310 distributes a part of the water in the first region A to the third region B by keeping the ice making tray 111 in a standby state for a predetermined time in a state of keeping the ice making tray 111 horizontal operation 1202. Specifically, a part of the water stored in the first region A may be moved to the third region B by bypassing the partition wall formed between the first region A and the third region B. In this case, the controller 310 may set the predetermined time to about 10 seconds to secure a time for a part of the water stored in the first region A to be moved to the third region B.

When the water supplied according to operation 1202 is uniformly stored in the first region A and the third region B, the controller 310 controls the ice making tray 111 to rotate in the first direction operation 1203. The controller 310 controls the rotation motor 113 connected to the ice making tray 111 to tilt the ice making tray 111 at a certain angle. Herein, the certain angle is the predetermined angle, and may correspond to about 8 to 10 degrees. However, the predetermined angle may be various angles depending on settings, and may be an angle sufficient for water to be moved depending on a size and structure of the ice making tray 111.

When the ice making tray 111 is tilted at the predetermined angle in operation 1203, the controller 310 keeps the ice making tray 111 in the standby state for the predetermined time so that a part of the water stored in the first region A and the third region B may be distributed to the second region C operation 1204.

Referring to FIG. 13, a part of the water stored in the first region A and the third region B may be moved through at least one of both ends of the partition wall parallel to the rotational axis of the ice making tray 111. The predetermined time in this case is a sufficient time for the water to be moved by the inclination, and may correspond to about 10 to 20 seconds.

The controller 310 rotates the ice making tray 111 in the second direction operation 1205. Specifically, the controller 310 may control the rotation motor 113 connected to the ice making tray 111 to return the ice making tray 111 to the horizontal state that is the original state. Herein, the second direction is opposite to the first direction described above, and corresponds to a direction of returning the tilted ice making tray 111 to the horizontal state.

For example, when water is uniformly stored in all of the ice making cells formed in the first region A, the second region C, and the third region B of the ice making tray 111, the controller 310 controls the rotation motor 113 to return the ice making tray 111 to the horizontal state.

When the ice making tray 111 returns to the horizontal state, the controller 310 controls the ice maker 100 to cool the water stored in the ice making tray 111 operation 1206. Therefore, according to the disclosure, water is uniformly supplied to all of the ice making cells even without forming a water channel in the ice making tray 111, so that the quality of ice making may be improved by preventing adjacent ice cubes from sticking together.

The disclosed embodiments may be implemented in the form of a recording medium storing instructions executable by a computer. The instructions may be stored in the form of program code, and when executed by a processor, a program module may be created to perform the operations of the disclosed embodiments. The recording medium may be implemented as a computer-readable recording medium.

The computer-readable recording medium includes any type of recording medium in which instructions readable by the computer are stored. For example, the recording medium may include a read only memory (ROM), a random access memory (RAM), a magnetic tape, a magnetic disk, a flash memory, an optical data storage device, and the like.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A refrigerator comprising:

an ice making tray in which a plurality of ice making cells form and comprising at least one partition wall dividing the plurality of ice making cells into a plurality of regions, each region of the plurality of regions comprising ice making cells separate from other regions of the plurality of regions;

a rotation motor configured to provide a driving force to rotate the ice making tray in a first direction or in a second direction opposite to the first direction; and a controller including memory and a processor, the controller configured to:

supply a predetermined amount of water to one region of the plurality of regions, in response to the supply of water to the one region of the plurality of regions being completed, control the rotation motor to rotate the ice making tray, in a horizontal state, in the first direction such that the ice making tray is tilted by a predetermined angle, in response to the ice making tray being tilted by the predetermined angle, maintain the ice making tray in a stopped state for a first predetermined time, and after the first predetermined time elapses, rotate the ice making tray in the second direction such that the ice making tray is in the horizontal state.

2. The refrigerator according to claim 1, wherein the plurality of regions of the ice making tray comprise:

a first region in which water is stored by the supply of water; and a second region in which a part of the water stored in the first region is stored by rotation of the ice making tray in the first direction.

3. The refrigerator according to claim 2, wherein based on the ice making tray being tilted by the predetermined angle, the part of the water stored in the first region moves to the second region.

4. The refrigerator according to claim 1, wherein the plurality of regions of the ice making tray comprise:

a first region in which water is stored by a supply of water;

a third region to which a part of the water stored in the first region is moved; and a second region in which the part of the water stored in the first region and the third region is stored by rotation of the ice making tray in the first direction.

5. The refrigerator according to claim 4, wherein the controller is further configured to:

in response to the supply of water to the one region of the plurality of regions being completed, maintain the ice making tray in the horizontal state for a second predetermined time such that the part of the water stored in the first region moves to the third region and then control the rotation motor to rotate the ice making tray in the first direction.

6. The refrigerator according to claim 1, wherein the controller is further configured to control a blowing fan to guide cold air to an ice maker so as to cool the water stored in the ice making tray.

7. A control method of a refrigerator provided with an ice maker comprising: an ice making tray, and a rotation motor configured to provide a driving force to rotate the ice making tray in a first direction or in a second direction opposite to the first direction, the control method comprising:

supplying a predetermined amount of water to one region of a plurality of regions of the ice making tray;

in response to the supply of water to the one region of the plurality of regions being completed, controlling the rotation motor to rotate the ice making tray, in a horizontal state, in the first direction such that the ice making tray is tilted by a predetermined angle;

in response to the ice making tray being tilted by the predetermined angle, maintaining the ice making tray in a stopped state for a predetermined time; and after the predetermined time elapses, controlling the rotation motor to rotate the ice making tray in the second direction such that the ice making tray is in the horizontal state.

8. The control method according to claim 7, wherein the plurality of regions of the ice making tray comprise:

a first region in which water is stored by a supply of water, and a second region in which a part of the water stored in the first region is stored by rotation of the ice making tray in the first direction.

9. The control method according to claim 8, wherein based on the ice making tray being tilted by the predetermined angle, the part of the water stored in the first region moves to the second region.

10. The control method according to claim 7, wherein the plurality of regions of the ice making tray comprise:

a first region in which water is stored by a supply of water;

a third region to which a part of the water stored in the first region is moved; and a second region in which the part of the water stored in the first region and the third region is stored by rotation of the ice making tray in the first direction.

* * * * *